US009125280B2

(12) United States Patent
Lee et al.

(10) Patent No.: US 9,125,280 B2
(45) Date of Patent: Sep. 1, 2015

(54) DISPLAY DEVICE AND WIRELESS POWER TRANSMISSION SYSTEM

(71) Applicant: AU Optronics Corporation, Hsin-Chu (TW)

(72) Inventors: Tsung-Shiun Lee, Hsin-Chu (TW); Jia-Wei Liu, Hsin-Chu (TW); Huang-Ti Lin, Hsin-Chu (TW); Yueh-Han Li, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 269 days.

(21) Appl. No.: 13/910,208

(22) Filed: Jun. 5, 2013

(65) Prior Publication Data

US 2014/0117869 A1 May 1, 2014

(30) Foreign Application Priority Data

Oct. 30, 2012 (TW) ..... 101140112 A

(51) Int. Cl.
*H05B 41/24* (2006.01)
*H05B 37/02* (2006.01)
*G09G 5/00* (2006.01)

(52) U.S. Cl.
CPC ..... *H05B 41/24* (2013.01); *G09G 5/003* (2013.01); *H05B 37/0272* (2013.01); *G09G 2330/02* (2013.01); *G09G 2370/16* (2013.01)

(58) Field of Classification Search
USPC ..... 315/209–226
See application file for complete search history.

(56) References Cited

U.S. PATENT DOCUMENTS

| | | | | |
|---|---|---|---|---|
| 6,434,030 | B1 | 8/2002 | Rehm et al. | |
| 7,697,307 | B2 | 4/2010 | Xiao et al. | |
| 7,909,483 | B2 * | 3/2011 | Jacobs et al. | 362/276 |
| 8,159,183 | B2 * | 4/2012 | Choi et al. | 320/108 |
| 2003/0015479 | A1 * | 1/2003 | Kuennen et al. | 210/748 |
| 2008/0058029 | A1 | 3/2008 | Sato et al. | |
| 2009/0290332 | A1 * | 11/2009 | Jacobs et al. | 362/183 |
| 2012/0025717 | A1 * | 2/2012 | Klusmann et al. | 315/152 |
| 2012/0039102 | A1 | 2/2012 | Shinoda | |
| 2012/0161535 | A1 * | 6/2012 | Jung et al. | 307/104 |
| 2013/0300202 | A1 * | 11/2013 | Keeling et al. | 307/104 |

FOREIGN PATENT DOCUMENTS

CN 101136561 A 3/2008

* cited by examiner

*Primary Examiner* — Brandon S Cole
(74) *Attorney, Agent, or Firm* — WPAT, P.C.; Justin King

(57) ABSTRACT

A display device with wireless power supply from power transmission means is disclosed in the disclosure. The display device comprises a display module, a system controlling module and a wireless power receiving module. The system controlling module is electrically connected to the display module. The wireless power receiving module is electrically connected to the system controlling module. The wireless power receiving module comprises a plurality of near-field coil units. The near-field coil units have individual receiving frequencies and individual output powers. The near-field coil units are configured to resonate with a transmission coil of the power transmission means. According to a transmission frequency on the transmission coil, the near-field coil unit with corresponding receiving frequency generates an electricity supply with a certain output power to the system controlling module. In addition, a wireless power transmission system is also disclosed herein.

20 Claims, 4 Drawing Sheets

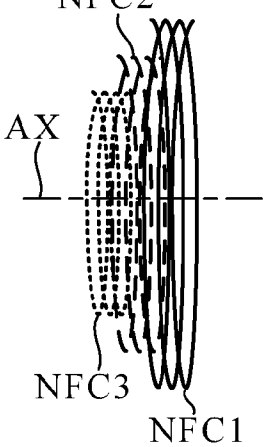
Fig. 3D
Fig. 3C
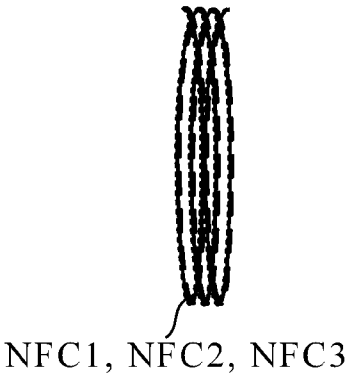
Fig. 3B
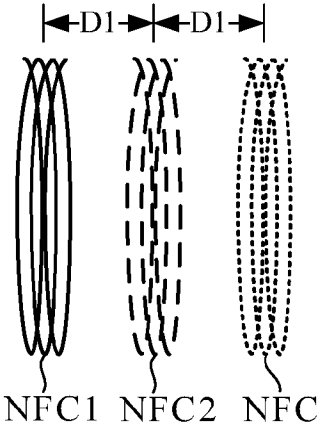
Fig. 3A

DISPLAY DEVICE AND WIRELESS POWER TRANSMISSION SYSTEM

RELATED APPLICATIONS

This application claims priority to Taiwan Application Serial Number 101140112, filed Oct. 30, 2012, which is herein incorporated by reference.

BACKGROUND

1. Field of Invention

The disclosure relates to a display device. More particularly, the disclosure relates to an electrical signal transmission method on a display device.

2. Description of Related Art

With the fast development of display technology, a digital display device has become popular in recent year. Most high-end display devices currently in the market are developed to have large screens, high resolutions and compact sizes. A traditional power supply module disposed in the display device usually includes a rectifier/stabilizer, a voltage converter and a voltage isolation structure. In general, the power supply module of the display device is connected via a power cable to an outlet of mains-electricity (e.g., household-electricity). The voltage converter is configured to convert an AC input (e.g., a three-phase AC voltage from 110 Volt. to 220 Volt.) provided by the outlet of mains-electricity into different system voltages and provide the voltages to other components (e.g., a display panel, a backlight source, a display processing circuit, a remote control signal receiving circuit, etc.) in the display device.

In order to save the power consumption during the stand-by period of the display device, the power supply module in the traditional display device must includes multiple voltage converters with different specifications (such as different sizes and different turns of windings) to convert the AC input into an operation voltage (e.g., 20 Volt., 30 Volt., 50 Volt. and other system operation voltages) or a stand-by voltage (such as 5 Volt.) However, in order to generate various power signals at different voltage levels, multiple voltage converters (each of which includes a magnetic core, a cable reel, coils on both sides and peripheral circuits) must be implemented in the traditional display device, such that the voltage converters will occupy extra space, increase the manufacturing cost and increase the electromagnetic interference (EMI) of the power supply module in the traditional display device. In addition, and the traditional power supply module requires a complex control circuit for providing a standby power, in order to save the energy consumption during the stand-by period.

Recently, parts of the display devices are capable of receiving their power signal wirelessly. However, aforementioned issues related to the traditional power supply module and the voltage converters are still existed in the display devices with wireless power transmission.

SUMMARY

An aspect of the disclosure provides a display device with wireless power supply from power transmission means. The display device includes a display module, a system controlling module and a wireless power receiving module. The system controlling module is electrically connected to the display module. The wireless power receiving module is electrically connected to the system controlling module. The wireless power receiving module includes a plurality of near-field coil units. Each of the near-field coil units has an individual receiving frequency and an individual output power. The near-field coil units are configured to resonate with a transmission coil of the power transmission means. According to a transmission frequency on the transmission coil, the near-field coil unit with the corresponding receiving frequency generates an electricity supply with the corresponding output power to the system controlling module.

Another aspect of the disclosure provides a wireless power transmission system, including power transmission means and a display device. The power transmission means include a transmission coil and a frequency control module. The frequency controlling module is configured to adjust a transmission frequency on the transmission coil. The display device includes a display module, a system controlling module and a wireless power receiving module. The system controlling module is electrically connected to the display module. The wireless power receiving module is electrically connected to the system controlling module. The wireless power receiving module includes a plurality of near-field coil units. The near-field coil units have individual receiving frequencies and individual output powers. The near-field coil units include at least one first near-field coil unit and a second near-field coil unit. Each of the first near-field coil units has a first receiving frequency and a first output power corresponding to an operation power of the display device. The second near-field coil unit has a second receiving frequency and a second output power corresponding to a stand-by power of the display device. The near-field coil units are configured to resonate with a transmission coil of the power transmission means. According to the transmission frequency on the transmission coil, the first near-field coil unit or the second near-field coil unit with the corresponding frequency generates an electricity supply corresponding to the operation power or the stand-by power to the system controlling module. The wireless power receiving module feeds back and controls the transmission frequency of the power transmission means so as to make the display device operate with the operation power or the stand-by power.

BRIEF DESCRIPTION OF THE DRAWINGS

In order to make the foregoing as well as other aspects, features, advantages, and embodiments of the disclosure more apparent, the accompanying drawings are described as follows:

FIGS. 3A, 3B, 3C and 3D illustrate schematic views of arrangement positions of multiple near-field coils in FIG. 2 in different embodiments.

DETAILED DESCRIPTION

In order to solve the aforesaid problem, a display device and a wireless power transmission system are provided by the disclosure. A wireless power receiving module of the display device has multiple near-field coil units. Each of the near-field coil units has an individual receiving frequency and an individual output power. According to a transmission frequency of a wireless-transmitted electrical signal, one of the near-field coil units with the corresponding receiving frequency may resonate with the wireless-transmitted electrical signal, such that the corresponding near-field coil unit will generate an electricity supply with a specific output power (e.g., with a specific output voltage).

In this case, the display device does not require any voltage converter for converting voltage into different levels. Various output powers can be formed on the display device by changing the transmission frequency of the wireless-transmitted electrical signal provided from the power transmission means. In addition, the display device can generate the electricity supplies including an electricity signal at an operation power and another electricity signal at a stand-by power, by implementing multiple passive near-field coil units without adding extra active components.

Figure 1:
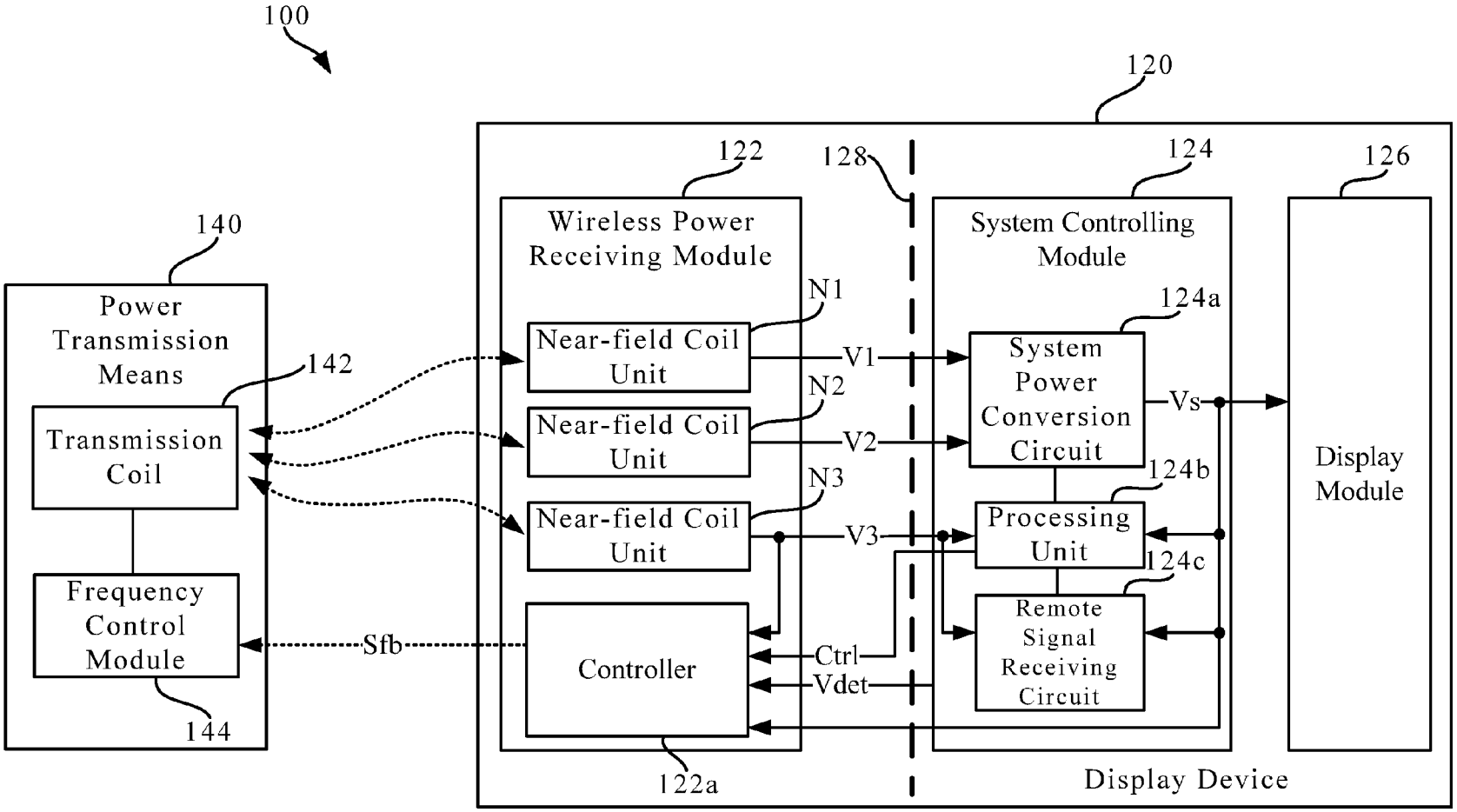
FIG. 1 illustrates a schematic view of a wireless power transmission system and a display device therein according to an embodiment of the disclosure.

Referring to FIG. 1, it is a schematic view of a wireless power transmission system 100 and a display device 120 therein according to an embodiment of the disclosure. The wireless power transmission system 100 is configured to provide an electricity supply to the display device 120.

As shown in FIG. 1, the wireless power transmission system 100 comprises power transmission means 140 and the display device 120. The power transmission means 140 comprise a transmission coil 142 and a frequency control module 144. The frequency control module 144 is configured to adjust a transmission frequency on the transmission coil 142. The power transmission means can be an electricity outlet, an electricity source or an electricity station capable of broadcasting a wireless-transmitted electricity signal.

The display device 120 comprises a wireless power receiving module 122, a system controlling module 124 and a display module 126. The system controlling module 124 is electrically connected to the display module 126. The wireless power receiving module 122 is electrically connected to the system controlling module 124. The wireless power receiving module 122 comprises a plurality of near-field coil units, for example including three near-field coil units N1, N2 and N3 in the embodiment of FIG. 1.

The near-field coil units N1, N2 and N3 are configured to resonate with the transmission coil 142 of the power transmission means 140. In this embodiment, each of the near-field coil units N1, N2 and N3 has individual receiving frequencies and individual output powers, which are different from each others. When the transmission frequency on the transmission coil 142 is changed, only one of the near-field coil units N1, N2 or N3 with the corresponding receiving frequency (i.e., the most approaching receiving frequency relative to the transmission frequency of the transmission coil 142) is triggered to resonate with the transmission coil 142 at highest degree among all of the near-field coil units N1, N2 or N3, because the receiving frequencies of the near-field coil units N1, N2 and N3 are different.

For example, when the transmission frequency on the transmission coil 142 is the most approached to the receiving frequency of the near-field coil unit N1, the near-field coil unit N1 generates an electricity supply V1 with the first output power to the system controlling module 124. At the same time, the near-field coil units N2 and N3 only have a little partial resonance with the transmission coil 142, and only a few electricity outputs may be generated.

Similarly, when the transmission frequency on the transmission coil 142 is nearest to the receiving frequency of the near-field coil unit N2 or N3, the near-field coil unit N2 or N3 generates an electricity supply V2 with a second output power or an electricity supply V3 with a third output power to the system controlling module 124 respectively. At the same time, the other two sets of near-field coil units only have a little partial resonance with the transmission coil 142, and only a few electricity outputs may be generated.

Figure 2:
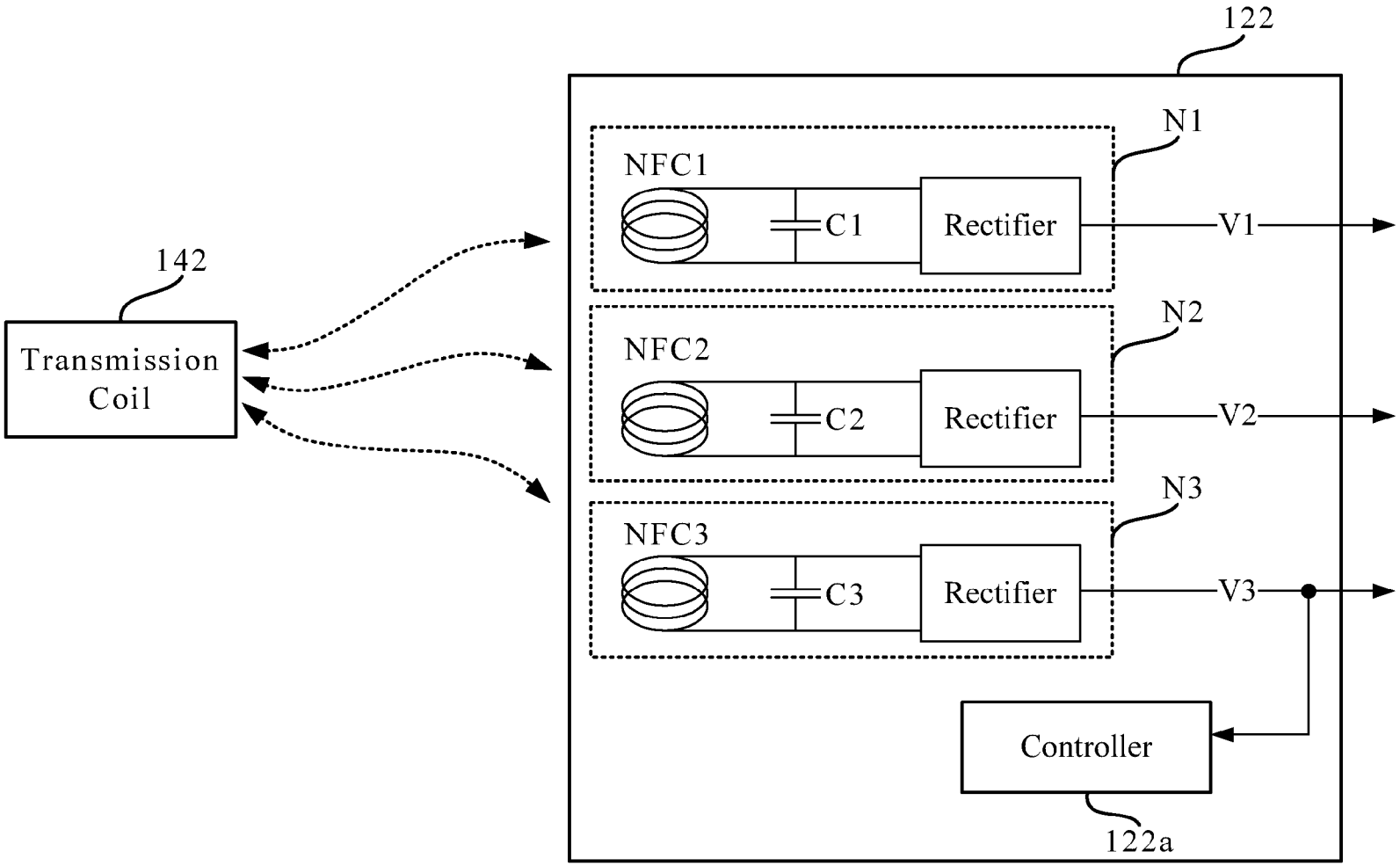
FIG. 2 illustrates a schematic view of a wireless power receiving module and multiple near-field coil units thereof according to an embodiment of the disclosure.

Referring to FIG. 2, it is a schematic view of the wireless power receiving module 122 and the near-field coil units N1, N2 and N3 thereof according to an embodiment of the invention.

As shown in FIG. 2, each of the near-field coil units N1, N2 and N3 comprises a near-field coil (NFC1, NFC2 or NFC3) and a capacitor (C1, C2 or C3) connected in parallel to the near-field coil. For example, the near-field coil unit N1 comprises the near-field coil NFC1 and the capacitor C1 connected in parallel with the near-field coil NFC1.

In this embodiment, the near-field coils NFC1, NFC2 and NFC3 are designed (e.g., with different turns of coils, different coil sizes or different coil materials, etc.) to have individual inductance values. Because of the aforesaid individual inductance values, the near-field coils NFC1, NFC2 and NFC3 may have individual output powers, such that the near-field coils NFC1, NFC2 and NFC3 generate the electricity supply V1 with the first output power, the electricity supply V2 with the second output power and the electricity supply V3 with the third output power respectively. In other words, the output powers of the near-field coil units N1, N2 and N3 can be determined by the inductance values of the near-field coils NFC1, NFC2 and NFC3.

In addition, the capacitors C1, C2 and C3 in the near-field coil units N1, N2 and N3 have individual capacitance values. The values of the resonance frequencies (i.e., the receiving frequencies) of the near-field coil units N1, N2 and N3 are determined by a reciprocal of a product of multiplying the inductance values of the near-field coil units N1, N2 and N3 (determined by the aforesaid near-field coils NFC1, NFC2 and NFC3) by the capacitance values of the near-field coil units N1, N2 and N3 (i.e., the capacitance values of the capacitors C1, C2 and C3).

Therefore, when the capacitance values of the aforesaid near-field coils NFC1, NFC2 and NFC3 are fixed, the values of the receiving frequencies of the near-field coil units N1, N2 and N3 can be designed by adjusting the capacitance values of the capacitors C1, C2 and C3 in the near-field coil units N1, N2 and N3. In other words, the near-field coil units N1, N2 and N3 have individual receiving frequencies which are determined by different capacitance values of the capacitors C1, C2 and C3.

As described above, through the inductance values of the near-field coils NFC1, NFC2 and NFC3 and the capacitance values of the capacitors C1, C2 and C3, the near-field coil units N1, N2 and N3 have individual receiving frequencies and individual output powers.

In this embodiment, the electricity supply V1 with the first output power (e.g., with a first output voltage level as 50 Volt.) generated by the near-field coil unit N1 and the electricity supply V2 with the second output power (e.g., with a second voltage level as 30 Volt.) generated by the near-field coil unit N2 can correspond to the operation powers required for the operation of the display device 120.

The electricity supply V3 with the third output power (e.g., with a third voltage level as 5 Volt.) generated by the near-field coil unit N3 corresponds to the stand-by power of the display device 120.

By changing the transmission frequency on the transmission coil 142 of the power transmission means 140, the individual output powers/output voltage levels can be generated by the induction effect on the display device 120, and the different operation powers required during an operating period the display device 120 or stand-by powers required during a stand-by period of the display device 120 can be further generated.

Reference is made to FIGS. 3A, 3B, 3C and 3D, which illustrate schematic views of arrangement positions of the near-field coils NFC1, NFC2 and NFC3 of FIG. 2 in different embodiments respectively.

As shown in the embodiment of FIG. 3A, the near-field coils NFC1, NFC2 and NFC3 of the near-field coil units N1, N2 and N3 are parallel to each other and separated by a specific interval D1. The interval D1 between the near-field coils NFC1, NFC2 and NFC3 can have any width capable to avoid the mutual interference.

As shown in the embodiment of FIG. 3B, the near-field coils NFC1, NFC2 and NFC3 may be overlapped with each other so that the three sets of coils occupy the minimum thickness or volume.

As shown in the embodiment of FIG. 3C, the near-field coils NFC1, NFC2 and NFC3 have different winding radiuses of the coils. In this embodiment, the winding radiuses of the near-field coils NFC1, NFC2 and NFC3 are ranged from large to small. The near-field coils NFC1, NFC2 and NFC3 may be arranged along the same axis and the projection positions of the near-field coils NFC1, NFC2 and NFC3 on an axis AX may be spaced with each other (as shown in FIG. 3C). In another embodiment, the projection positions of the near-field coils NFC1, NFC2 and NFC3 on the axis AX also may be overlapped (not shown). In this way, the three sets of coils with different winding radiuses also may occupy a minimal volume with a minimal thickness.

As shown in the embodiment of FIG. 3D, the near-field coils NFC1, NFC2 and NFC3 are independent from each other and are arranged adjacently on the same plane PL.

The arrangement manners of the near-field coils NFC1, NFC2 and NFC3 in the aforesaid embodiments are all suitable to achieve the effect of the disclosure. Since not all the arrangement manners of the near-field coils can be described in the aforesaid embodiments, all the equivalent arrangement manners with similar structures or capable to achieve the same effect, should fall into the scope of the disclosure.

The wireless power receiving module 122 of the display device 120 having three sets of near-field coil units N1, N2 and N3 is described exemplarily in the aforesaid embodiments. The display device 120 of the disclosure comprises at least two sets of near-field coil units for generating the electricity supplies corresponding to the operation power and the stand-by power. In practical use, if there are more different powers/voltage levels are required by the display unit 120, more near-field coil units also can be disposed in the display unit 120 to generate more varied operation powers/voltage levels, and the disclosure is not limited to the three sets of near-field coil units.

With the wireless power transmission system 100 of the disclosure, the display device 120 does not required to implement additional transformers, and the electricity supplies with individual powers can be generated to the system controlling module 124 by utilizing the near-field coil units, which have simple structures and can be realized by passive components.

As shown in FIG. 1, the system controlling module 124 may comprise a system power conversion circuit 124*a*, a processing unit 124*b* and a remote control signal receiving circuit 124*c*.

In practical use, the remote control signal receiving circuit 124*c* may be an infrared signal receiver or other remote control signal receivers with the equivalent effect. The remote control signal receiving circuit 124*c* is configured to receive an external remote control instruction so as to switch the display device 120 between an operation state and a stand-by state.

The processing unit 124*b* is electrically connected to the system power conversion circuit 124*a* and the remote control signal receiving circuit 124*c*. According to the external remote control instruction received by the remote control signal receiving circuit 124*c*, the processing unit 124*b* generates a control signal Ctrl to a controller 122*a* in the wireless power receiving module 122.

According to the control signal Ctrl generated by the processing unit 124*b*, the controller 122*a* of the wireless power receiving module 122 transmits a feedback signal Sfb to the power transmission means 140 wirelessly, to feed back and control the transmission frequency on the transmission coil 142.

In this embodiment, the system power conversion circuit 124*a* is electrically connected to the near-field coil units N1 and N2.

For example, under the stand-by state, the transmission frequency on the transmission coil 142 corresponds to the receiving frequency of the near-field coil unit N3, and the near-field coil unit N3 generates the electricity supply V3 corresponding to the stand-by power. The electricity is supplied to the controller 122*a*, the remote control signal receiving circuit 124*c* and the processing unit 124*b* directly without using the system power conversion circuit 124*a*. Basic stand-by functions on the display device 120 (e.g., a remote control function, a stand-by lamp signal display and/or other basic functions) are active. In addition, under the stand-by state, the electricity supply V3 generated by the near-field coil unit N3 is not transmitted to the system power conversion circuit 124*a* and the display module 126, thereby saving the electricity consumption under the stand-by state.

When the remote control signal receiving circuit 124*c* receives the external remote control instruction representing "device on", the remote control signal receiving circuit 124*c* transmits the control signal Ctrl to the controller 122*a*, and the controller 122*a* transmits the feedback signal Sfb to the power transmission means 140 wirelessly. At this time, according to the feedback signal Sfb, the frequency control module 144 of the power transmission means 140 can adjust the transmission frequency on the transmission coil 142 to correspond to the receiving frequency of the near-field coil unit N1 or the near-field coil unit N2, so as to switch the display device 120 from the stand-by state to the operation state.

In addition, as shown in FIG. 1, the display device 120 may further comprise a shielding layer 128 which is configured between the wireless power receiving module 122 and other components in the display device 120 (e.g., the system controlling module 124 and the display module 126) so as to avoid the electromagnetic interference from the wireless power receiving module 122 to other components when the wireless power receiving module 122 receives a high-frequency signal. In the embodiment of FIG. 1, the shielding layer 128 may be made of a metal material or other conductive materials, configured between the wireless power receiving module 122 and the system controlling module 124, but the disclosure is not limited to this.

Figure 4:
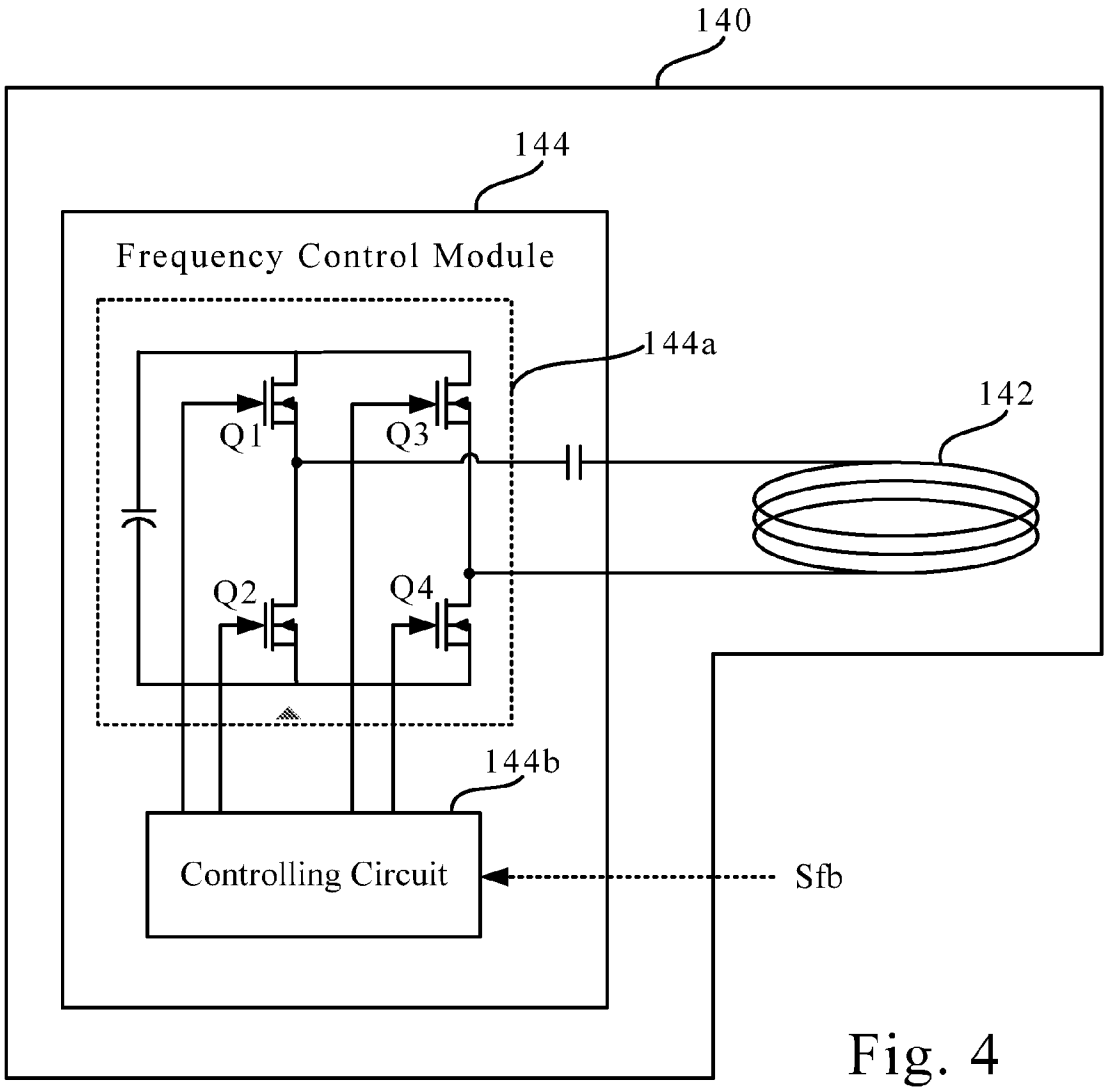
FIG. 4 illustrates a schematic view of power transmission means of a wireless power transmission system according to an embodiment of the disclosure.

Referring to FIG. 4 at the same time, it illustrates a schematic view of the power transmission means 140 of the wireless power transmission system 100 according to an embodiment of the disclosure. As shown in FIG. 4, the power transmission means 140 comprise the transmission coil 142 and the frequency control module 144.

The frequency control module 144 comprises a switching circuit 144*a* and a controlling circuit 144*b*. The switching circuit 144*a* is coupled with the transmission coil 142, including a plurality of switching units Q1-Q4 which are switched in an order. In this embodiment, the switching circuit 144*a* is a full-bridge inversion switching circuit, but the disclosure is not limited to this.

The controlling circuit 144*b* of the frequency control module 144 is configured to receive the feedback signal Sfb from the display device. According to the feedback signal Sfb, the controlling circuit 144*b* of the frequency control module 144 adjusts a switching frequency of the switching units Q1-Q4 so as to adjust the transmission frequency on the transmission coil 142.

Under the operation state, the transmission frequency on the transmission coil 142 corresponds to the receiving frequency of the near-field coil unit N1 or the near-field coil unit N2. The near-field coil unit N1 or the near-field coil unit N2 generates the electricity supply V1 or V2 corresponding to the operation power to the system power conversion circuit 124*a*, so that the system power conversion circuit 124*a* generates a system voltage signal Vs to supply power to the controller 122*a*, the remote control signal receiving circuit 124*c*, the processing unit 124*b* and the display module 126, thereby supplying the electricity under the normal operation state.

Under the operation state, the system controlling module 124 also can detect the operation voltage values of the near-field coil units N1, N2 and N3 to generate a voltage detecting signal Vdet to the controller 122*a*. The controller 122*a* can transmit the feedback signal Sfb to the power transmission means 140 wirelessly according to the voltage detecting signal Vdet. At this time, according to the feedback signal Sfb, the frequency control module 144 of the power transmission means 140 finely adjusts the transmission frequency on the transmission coil 142 (for example finely adjusting near the transmission frequency corresponding to the near-field coil unit N1) or switches the transmission frequency of the transmission coil 142 to transmission frequencies with different frequency bands (for example switching from the transmission frequency corresponding to the near-field coil unit N1 to the transmission frequency corresponding to the near-field coil unit N2).

Additionally, when the remote control signal receiving circuit 124*c* receives the external remote control instruction representing "device off", the remote control signal receiving circuit 124*c* also can transmit the corresponding control signal Ctrl to the controller 122*a*, and the controller 122*a* transmits the feedback signal Sfb to the power transmission means 140 wirelessly. At this time, according to the feedback signal Sfb, the frequency control module 144 of the power transmission means 140 can adjust the transmission frequency on the transmission coil 142 to the receiving frequency of the corresponding near-field coil unit N3, so as to switch the display device 120 from the operation state to the stand-by state.

In view of the above, a display device and a wireless power transmission system are provided by the disclosure. The wireless power receiving module of the display device has multiple near-field coil units. The near-field coil units have individual receiving frequencies and individual output powers. According to the transmission frequency of the electrical signal which is transmitted wirelessly, the near-field coil unit with the corresponding receiving frequency resonates with the electrical signal so as to generate the electricity supply with a certain output power (e.g., with a certain output voltage). In this way, the display device may not need the voltage converter to perform the voltage conversion. The power transmission means can be configured to change the transmission frequency of the wireless transmission, so as to form various output powers on the display device. In addition, the display device can conveniently generate the electricity supply with an operation power and a stand-by power by only configuring multiple passive near-field coil units, without using additional active components.

Although the disclosure has been disclosed with reference to the above embodiments, these embodiments are not intended to limit the disclosure. Those of skills in the art can make various modifications and changes without departing from the spirit and scope of the disclosure. Therefore, the scope of the disclosure shall be defined by the appended claims.

What is claimed is:

1. A display device with wireless power supply from power transmission means, the display device comprising:

a display module;

a system controlling module, electrically connected to the display module; and a wireless power receiving module, electrically connected to the system controlling module, the wireless power receiving module comprising:

a plurality of near-field coil units, wherein each of the near-field coil units have an individual receiving frequency and an individual output power, the near-field coil units are configured to resonate with a transmission coil of the power transmission means, and according to a transmission frequency on the transmission coil, the near-field coil unit with the corresponding receiving frequency generates an electricity supply with the corresponding output power to the system controlling module.

2. The display device of claim 1, wherein each of the near-field coil units comprises a near-field coil and a capacitor connected in parallel to the near-field coil.

3. The display device of claim 2, wherein the near-field coils of the near-field coil units are parallel to each other and are spaced, overlapped, arranged on the same axis or arranged adjacently on the same plane.

4. The display device of claim 2, wherein each of the near-field coils has an individual inductance value, so as to form the near-field coil units with individual output powers.

5. The display device of claim 2, wherein each of the capacitors has an individual capacitance value, so as to form the near-field coil units with individual receiving frequencies.

6. The display device of claim 1, wherein the near-field coil units comprise at least one first near-field coil unit and a second near-field coil unit, wherein each of the first near-field coil units has a first receiving frequency and a first output power, the second near-field coil unit has a second receiving frequency and a second output power, the first output power corresponds to an operation power of the display device and the second output power corresponds to a stand-by power of the display device.

7. The display device of claim 6, wherein the system controlling module comprises:

a system power conversion circuit, electrically connected to the at least one first near-field coil unit;

a remote control signal receiving circuit, configured to receive an external remote control instruction so as to switch the display device between an operation state and a stand-by state; and a processing unit, electrically connected to the system power conversion circuit and the remote control signal receiving circuit, wherein according to the external remote control instruction received by the remote control signal receiving circuit the processing unit generates a control signal to the wireless power receiving module.

8. The display device of claim 7, wherein the wireless power receiving module comprises a controller which transmits a feedback signal to the power transmission means wirelessly according to the control signal generated by the processing unit so as to feed back and control the transmission frequency on the transmission coil.

9. The display device of claim 8, wherein under the stand-by state, the transmission frequency on the transmission coil corresponds to the second receiving frequency of the second near-field coil unit and the second near-field coil unit generates an electricity supply corresponding to the stand-by power to the controller, the remote control signal receiving circuit and the processing unit.

10. The display device of claim 8, wherein under the operation state, the transmission frequency on the transmission coil corresponds to the first receiving frequency of one of the first near-field coil units, and the first near-field coil unit generates an electricity supply corresponding to the operation power to the system power conversion circuit, so that the system power conversion circuit generates a system voltage signal to supply power to the controller, the remote control signal receiving circuit, the processing unit and the display module.

11. A wireless power transmission system, comprising:

power transmission means, comprising a transmission coil and a frequency control module which is configured to adjust a transmission frequency on the transmission coil; and a display device, comprising:

a display module;

a system controlling module, electrically connected to the display module; and a wireless power receiving module, electrically connected to the display module, wherein the wireless power receiving module comprises a plurality of near-field coil units, each of the near-field coil units has an individual receiving frequency and an individual output power, the near-field coil units comprise at least one first near-field coil unit and a second near-field coil unit, each of the first near-field coil units has a first receiving frequency and a first output power corresponding to an operation power of the display device, the second near-field coil unit has a second receiving frequency and a second output power corresponding to a stand-by power of the display device, the near-field coil units are configured to resonate with the transmission coil of the power transmission means, according to the transmission frequency on the transmission coil the first near-field coil unit or the second near-field coil unit with the corresponding frequency generates an electricity supply corresponding to the operation power or the stand-by power to the system controlling module, and the wireless power receiving module feeds back and controls the transmission frequency on the power transmission means to make the display device operate with the operation power or the stand-by power.

12. The wireless power transmission system of claim 11, wherein the frequency control module comprises a switching circuit coupled with the transmission coil, the switching circuit comprises a plurality of switching units which are switched in an order and the frequency control module adjusts a switching frequency of the switching units to adjust the transmission frequency on the transmission coil.

13. The wireless power transmission system of claim 12, wherein the switching circuit is a full-bridge inversion switching circuit.

14. The wireless power transmission system of claim 11, wherein each of the near-field coil units comprises a near-field coil and a capacitor which is connected in parallel to the near-field coil.

15. The wireless power transmission system of claim 14, wherein the near-field coils have individual inductance values, so as to form the near-field coil units with individual output powers.

16. The wireless power transmission system of claim 15, wherein the capacitors have individual capacitance values, so as to form the near-field coil units with individual receiving frequencies.

17. The wireless power transmission system of claim 11, wherein the system controlling module comprises:

a system power conversion circuit, electrically connected to the at least one first near-field coil unit;

a remote control signal receiving circuit, configured to receive an external remote control instruction so as to switch the display device between an operation state and a stand-by state; and a processing unit, electrically connected to the system power conversion circuit and the remote control signal receiving circuit, wherein according to the external remote control instruction received by the remote control signal receiving circuit the processing unit generates a control signal to the wireless power receiving module.

18. The wireless power transmission system of claim 17, wherein the wireless power receiving module comprises a controller which transmits a feedback signal to the power transmission means wirelessly according to the control signal generated by the processing unit so as to feed back and control the transmission frequency on the transmission coil.

19. The wireless power transmission system of claim 18, wherein under the stand-by state, the transmission frequency on the transmission coil corresponds to the second receiving frequency of the second near-field coil unit and the second near-field coil unit generates an electricity supply corresponding to the stand-by power to the controller, the remote control signal receiving circuit and the processing unit.

20. The wireless power transmission system of claim 18, wherein under the operation state, the transmission frequency on the transmission coil corresponds to the first receiving frequency of one of the first near-field coil units, and the near-field coil unit generates an electricity supply corresponding to the operation power to the system power conversion circuit so that the system power conversion circuit generates a system voltage signal to supply power to the controller, the remote control signal receiving circuit, the processing unit and the display module.

* * * * *